United States Patent [19]

Kimura

[11] Patent Number: 5,046,661

[45] Date of Patent: Sep. 10, 1991

[54] POSTAL LEAFLETS FOR DIRECT MAILS

[76] Inventor: Yoshikazu Kimura, 36, Kakadacho, Karahashi, Minamiku, Kyoto, Japan, 601

[21] Appl. No.: 446,862

[22] Filed: Dec. 6, 1989

[51] Int. Cl.[5] ..... B65D 27/34

[52] U.S. Cl. ..... 229/92.1; 206/610

[58] Field of Search ..... 229/92.1, 69, 92.3; 206/610

[56] References Cited

U.S. PATENT DOCUMENTS

| | | | |
|---|---|---|---|
| 1,299,021 | 4/1919 | Planche | 229/92.1 |
| 3,126,148 | 3/1964 | Hanson | 229/92.1 |
| 3,197,121 | 7/1965 | Hayes, Jr. | 229/92.1 |
| 3,977,597 | 8/1976 | Wise et al. | 229/92.1 X |

FOREIGN PATENT DOCUMENTS

| | | | |
|---|---|---|---|
| 375676 | 7/1907 | France | 229/92.1 |
| 1215307 | 4/1960 | France | 229/92.1 |
| 2431964 | 3/1980 | France | 229/92.1 |
| 223314 | 11/1942 | Switzerland | 229/92.1 |

*Primary Examiner*—Stephen Marcus
*Assistant Examiner*—Jes F. Pascua
*Attorney, Agent, or Firm*—Fidelman & Wolffe

[57] ABSTRACT

A postal leaflet for use as direct mails, the leaflet comprising three folded pages carrying information, the pages being releasably adhered to each other at their upper, lower and side joining fringes.

7 Claims, 3 Drawing Sheets

FIG. 4(a)
PRIOR ART
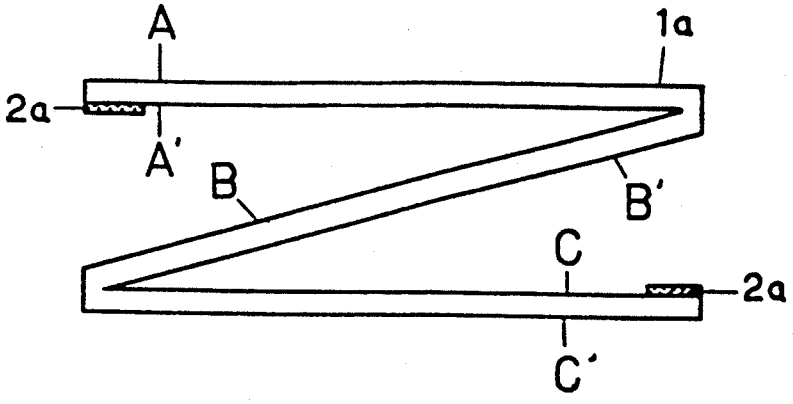
FIG. 4(b)
PRIOR ART
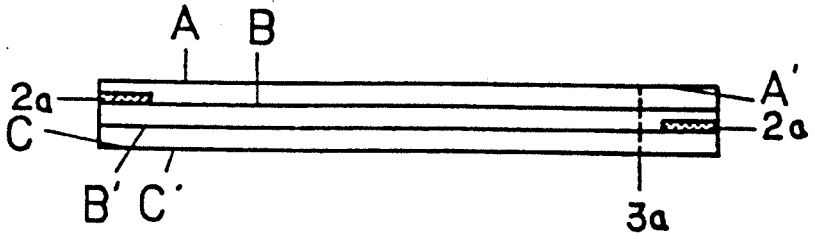
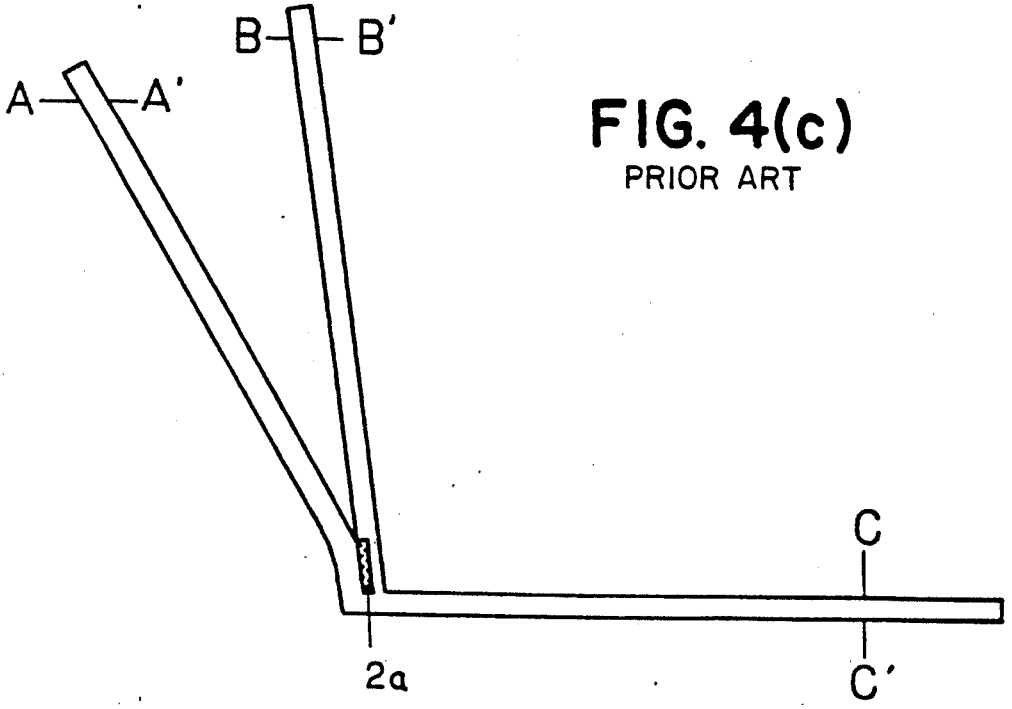
FIG. 4(c)
PRIOR ART

POSTAL LEAFLETS FOR DIRECT MAILS

BACKGROUND OF THE INVENTION

The present invention relates to leaflets mailable as advertising direct mails by merchants and reporting sheets of credit balance by banks and credit card companies. More particularly, the present invention relates to postal leaflets for such use, the leaflet comprising three folded pages each carrying advertising phrases and reporting items, hereinafter referred to as "information". The folded pages have their fringes adhered to each other so as to close the entire body of the leaflet. Hereinafter the closed leaflet is referred to as an enveloped leaflet though no conventional envelop is used.

Nowadays various types of advertising circulars are used, among which direct mails are in wide use. Banks, credit card companies etc. monthly report credit balances to the list of customers. Such reports contain individual information which is required to be sent under cover. The known forms of direct mail are either ordinary postcards including double cards (reply-paid postcards) or enveloped letters. Postcards are disadvantageous in that the information printed on one side is in an uncovered state. In contrast, enveloped letters are advantageous in having an information under the cover of envelops. However, the letters are more expensive than postcards because of the more expensive postal stamps and the labor cost.

In order to solve the problems pointed out with respect to direct mails in the form of postcards and letters, a new form of leaflets have been made which comprise folded pages containing information held under cover.

By reference to FIGS. 4(*a*), 4(*b*) and 4(*c*), the known form of leaflet will be described:

A sheet (e.g. paper) 1*a* of a A4 size or slightly larger size is folded in three, which is commonly called "Z folds" named after the shape of its cross section. The sheet has pages (A), (B) and (C). In the illustrated example the page (A) has a front side on which a name and address are written. Either of the joining pages has an adhesive zones 2*a* coated along its fringe so as to form an enveloped leaflet as shown in FIG. 4(*b*). The recipient opens the enveloped leaflet as shown in FIG. 4(*c*) by cutting it along a line 3*a*. The other joined part remains at which the pages (A), (B) and (C) are joined like a book, hereinafter referred to as a "book style leaflet".

As is evident from FIG. 4(*c*), each page (A), (B) and (C) constitutes an independent page, which limits the space for placing information. Designers and copywriters prefer larger spaces which allow free layout of their designs and ideas. As shown in FIG. 4(C) the information on the pages (A), (B) and (C) are independently displayed; for example, when the information is a photograph or picture, it becomes discontinuous page by page. The discontinued photograph reduces its value. The book style leaflets does not allow information to be displayed as extensively as at one sight.

SUMMARY OF THE INVENTION

Accordingly, an object of the present invention is to provide a leaflet mailable as direct mails which keeps the secrecy of information.

Another object of the present invention is to provide a postal leaflet which can contain as much information as possible.

According to one aspect of the present invention there is provided a postal leaflet which comprises three folded pages carrying information, the pages being releasably adhered to each other at their upper, lower and side joining fringes.

According to another aspect of the present invention, there is provided a postal leaflet which comprises three folded pages carrying information, the pages being adhered to each other at their upper, lower and side joining fringes and lateral cut means produced inward of the upper and lower joined fringes, and vertical cut means produced on the front side and rear side of the leaflet.

There are two methods of joining the pages; one is the permanent joint and the other is the releasable joint (commonly called "sham joint"). When the joining fringes are releasably joined, there is no need for providing the leaflet with a cut means. Preferably, the vertical cut means comprises double lines whereby a sheet segment between the two lines is peeled.

Other objects and advantages of the present invention will become more apparent from the following detailed description, when taken in conjunction with the accompanying drawings, which show, for the purpose of illustration only, embodiments in accordance with the present invention.

BRIEF DESCRIPTION OF THE DRAWINGS

FIGS. 4(*a*) to 4(*c*) are diagrammatic views showing a prior art book style leaflet.

DETAILED DESCRIPTION OF THE PREFERRED EMBODIMENTS

Figure 1:
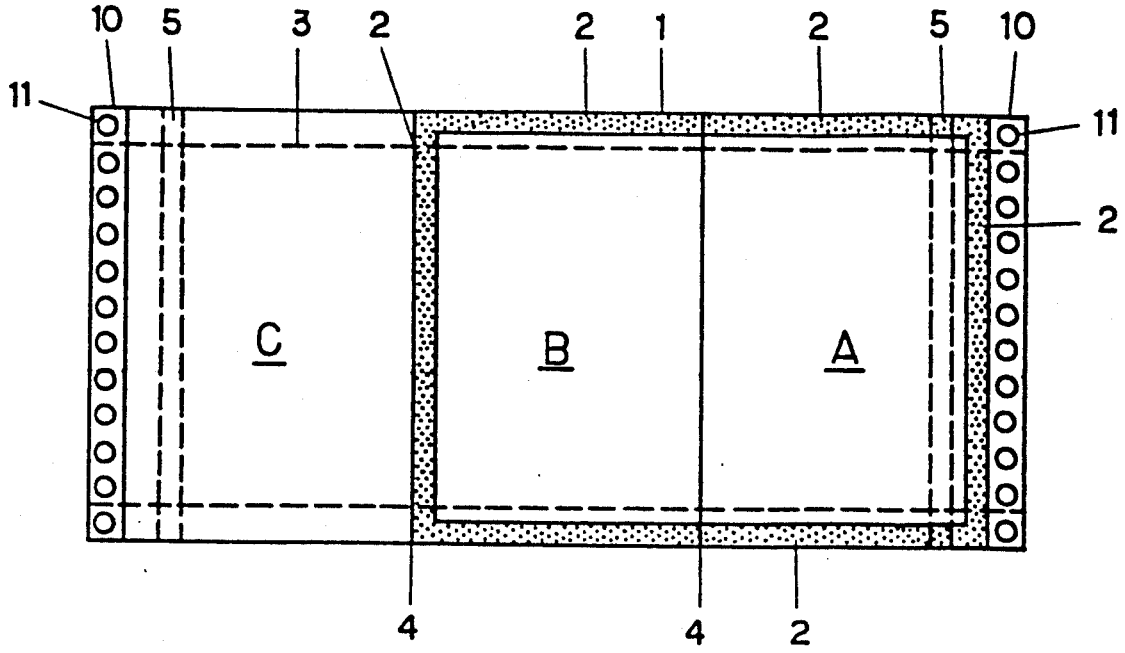
FIG. 1 is a front view showing a postal leaflet according to the present invention.
Figure 2:
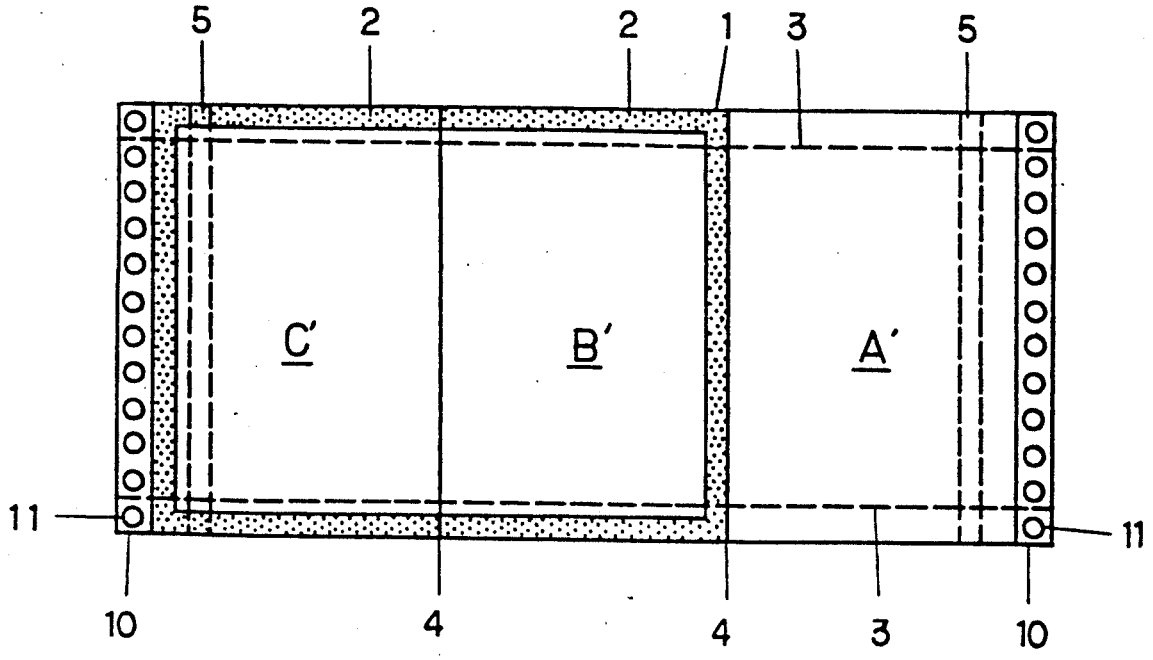
FIG. 2 is a rear view of the postal leaflet of FIG. 1.

Referring to FIGS. 1 and 2, the leaflets are made of a long continuous web supplied from a roller or a cassette on a mass-production line. For simplicity the drawings show a segment of the web as a unit sheet, hereinafter referred to as "sheet". One sheet 1 constitutes one leaflet. The sheet 1 has ears 10 at opposite sides including sprocket holes 11. The ears 10 remain uncut until the final stage of process. The process finishes with cutting the ears 10.

The sheet 1 is provided with two foldable lines 4 along which it is folded in the "Z folds". In this way the sheet 1 has three sections (A), (B) and (C) in the front side as shown in FIG. 1, and (A'), (B') and (C') in the rear side as shown in FIG. 2. The sections (A) and (A') constitute one page, and likewise the other sections (B) and (B'), (C) and (C') constitute respective pages. In this specification the page means an entire leaf, and the page face means one side thereof.

The page faces (A) and (B), and (B') and (C') are provided with adhesive zones 2 along their joining fringes. Hereinafter these zones are referred to as the "adhesive coated fringes". The sheet 1 is provided with first cut lines 3 slightly inward of the upper and lower adhesive coated fringes 2. The first cut lines 3 are provided through all the pages. Preferably the cut lines 3 are continuous punched lines. In addition to the first cut lines 3, the page faces (A), (A') and (C), (C') are respectively provided with second cut lines 5, preferably double lines at a distance of about 8 mm as shown in FIGS. 1 and 2. Unlike the first cut lines the second cut lines 5 are provided on the page face (A), (A'), (C) and (C'), but not through all the pages. Alternatively, the second cut line 5 can be single or they comprises a string embedded in the sheet 1. By pulling the string the sheet 1 is torn along the string. It is desirable that a direction is printed for a recipient, saying "Please tear here". The second cut lines 5 can be painted red or any other color so as to call recipient's attention. When the adhesive joint is not permanent but releasable (sham joint), the joined fringes can be opened by a recipient of the leaflet. There is no need for providing the cut lines.

The adhesive which is coated on the joining fringes 2 is preferably a heat sensitive adhesive or alternatively a pressure sensitive adhesive which is normally covered with a paper.

Figure 3A:
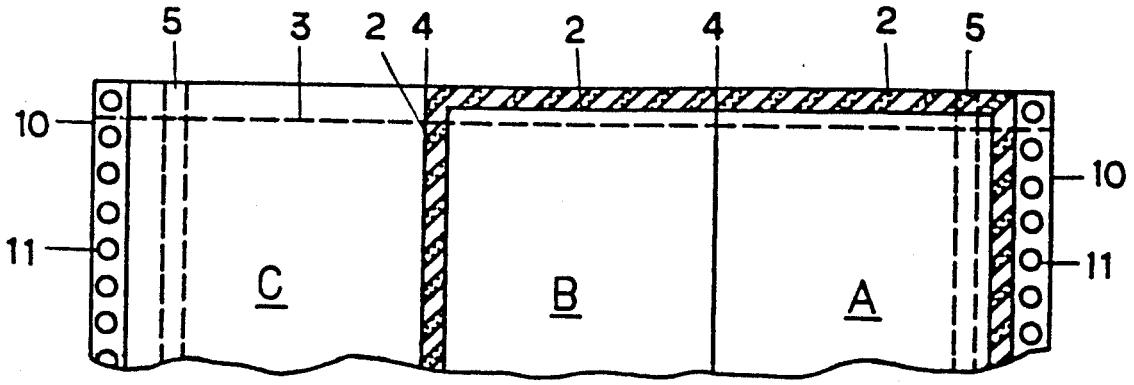
FIGS. 3(*a*), 3(*b*) and 3(*c*) are examples of adhesive coated fringes showing various patterns of adhesive coat.
Figure 3B:
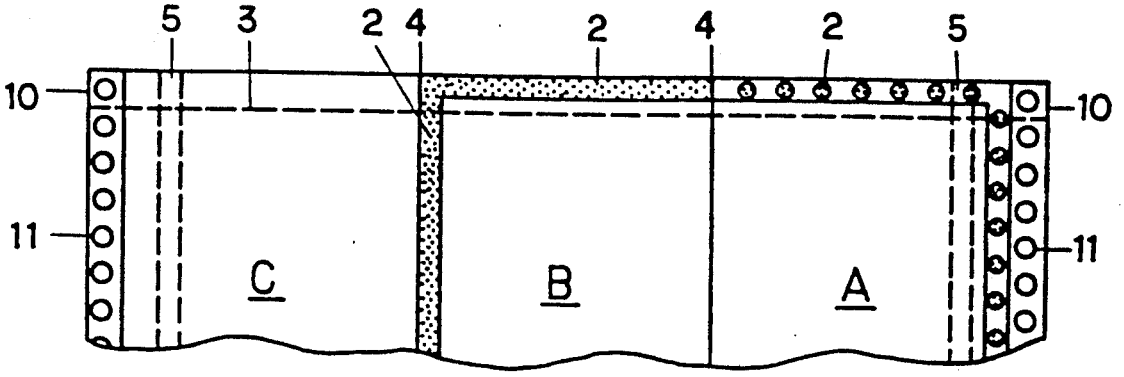
Figure 3C:
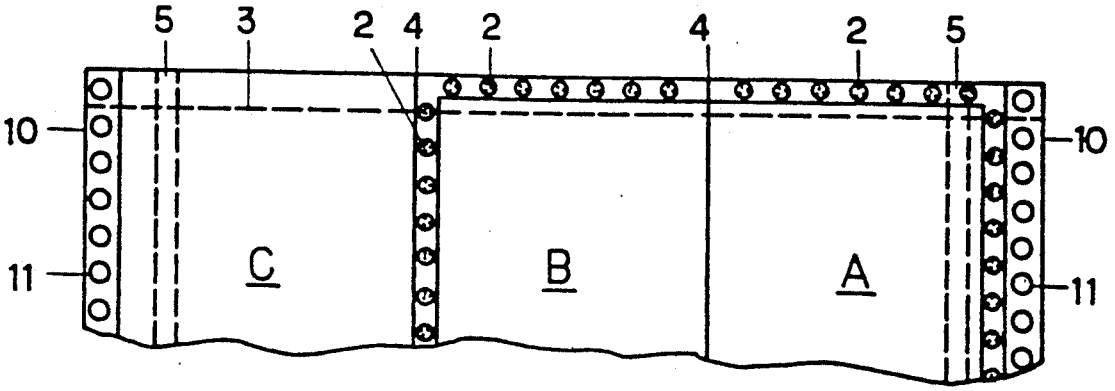

FIGS. 3(*a*), 3(*b*) and 3(*c*) show various patterns of adhesive cost on the joining fringes. FIG. 3(*a*) shows a hatching pattern, and FIG. 3(*c*) shows a dot pattern. FIG. 3(*b*) shows a combination of a dot pattern in the page face (A) and a full face coat in the page face (B). The hatching pattern is advantageous in that the adhesive coated lines in the page faces (A) and (B) cross when they are folded along the foldable line 4 so that adhered points are surely produced. The dots patterns are advantageous in that adhesive absent spots between one adhered point and another allow air to pass through, thereby avoiding the build-up of air in the enveloped leaflet. However, care must be taken not to keep the adhered points at such a distance as to allow other people to spy into the enveloped leaflet through between one adhered point and another.

In FIG. 1 the page face (C) is a page for postal stamp, having no adhesive zone. The page face (C') has no adhesive zone and general advertising phrases and pictures can be printed.

A recipient opens the enveloped leaflet by cutting along the lines 3 and 5. Since the lines 5 constitute a means for permitting each page upon which each of said lines are formed to be peeled from the underlying page face (B, B') without tearing the underlying page, the enveloped leaflet is extensively opened as shown in FIGS. 1 and 2. This may be accomplished by cutting or peeling the segment formed in the page face by lines 5, from said page face. The information can be viewed at one sight, which makes it unnecessary to turn the pages like the conventional book style leaflet. When the joint is releasable (sham joint), the joined fringes can be opened by hand without reliance upon the cut lines.

The Z style folding is advantageous in that the ears 10 of the sheet 1 remain uncut until the final stage of process. After the sheet 1 is folded in three as described above, the ears 10 are allowed to project outward of the folded pages, thereby enabling web to stay on the conveyor until the final stage. This means that the automatic process can be continued until the final stage of process.

What is claimed is:

1. A postal leaflet for use as direct mail, the leaflet comprising:

three folded pages carrying information, the pages being adhered to each other at their upper, lower and side joining fringes to form two end pages and an underlying page;

lateral cuts disposed inward of the upper and lower joined fringes; and vertical cuts disposed on the front side and back side of the leaflet in double lines inward of each joined fringe and which form segments of respective page faces between said cuts, wherein the vertical cuts forming the segments of the respective page faces between the double lines constitute means for permitting each page upon which each of said vertical cuts are formed to be peeled from the underlying page without tearing the underlying page, whereby the postal leaflet can be opened into a continuous flat sheet.

2. A postal leaflet as defined in claim 1, wherein the joining fringes have the adhesive coated in a dot pattern.

3. A postal leaflet as defined in claim 1, wherein the joining fringes have the adhesive coated in a hatching pattern.

4. A postal leaflet as defined in claim 1, wherein one of the joining fringe has the adhesive coated in a dot pattern and the other has it coated in full.

5. A postal leaflet as defined in claim 1, wherein the joining fringes have the adhesive coated in a dot pattern.

6. A postal leaflet as defined in claim 1, wherein the joining fringes have the adhesive coated in a hatching pattern.

7. A postal leaflet as defined in claim 1, wherein one of the joining fringe has the adhesive coated in a dot pattern and the other has it coated in full.

* * * * *